US005850881A

United States Patent [19]

Rodger et al.

[11] Patent Number: 5,850,881

[45] Date of Patent: Dec. 22, 1998

[54] DRILL PIPE FLOAT VALVE AND METHOD OF MANUFACTURE

[75] Inventors: John E. Rodger, San Antonio; Randle E. Ford, New Braunfels, both of Tex.

[73] Assignee: Baker Hughes Incorporated, Houston, Tex.

[21] Appl. No.: 898,147

[22] Filed: Jul. 22, 1997

Related U.S. Application Data

[62] Division of Ser. No. 534,624, Sep. 27, 1995, Pat. No. 5,687,792.

[51] Int. Cl.[6] ..... E21B 33/12

[52] U.S. Cl. ..... 166/327; 166/181

[58] Field of Search ..... 166/325, 327, 166/148, 386, 387, 285, 181

[56] References Cited

U.S. PATENT DOCUMENTS

| | | |
|---|---|---|
| 2,161,282 | 6/1939 | Crowell . |
| 2,267,339 | 12/1941 | Paulsen . |
| 2,791,279 | 5/1957 | Clark, Jr. . |
| 3,332,499 | 7/1967 | Harris et al. . |
| 3,385,370 | 5/1968 | Knox et al. . |
| 3,572,633 | 3/1971 | Gaffney . |
| 3,997,009 | 12/1976 | Fox . |
| 4,624,316 | 11/1986 | Baldridge et al. . |
| 5,379,835 | 1/1995 | Streich . |
| 5,450,903 | 9/1995 | Budde . |

FOREIGN PATENT DOCUMENTS

| | | |
|---|---|---|
| 2 036 131 | 10/1978 | United Kingdom . |
| 2 099 045 | 5/1981 | United Kingdom . |

OTHER PUBLICATIONS

Technical Manual: "Bakerline Model F Drill, Pipe Float Valve, Prod. No. 480–13", Dated Mar. 30, 1981, 1 pg.

Advertisement: Bakerine Section XI, Drill Pipe Float Valve, 2 pgs.

*Primary Examiner*—Frank Tsay

*Attorney, Agent, or Firm*—Browning Bushman

[57] ABSTRACT

A float valve 10 includes a valve body 12 for sealing engagement with a float sub 20 having threads for threaded engagement with an oilfield tubular. A valve element 40 includes a stem 50, 70 and a valve cone 52, 80 secured thereto. The valve cone is configured for sealing engagement with a seat 58 on the valve body. An elastomeric seal 48 may also be provided for sealing engagement with the valve body. The stem 50, 70 and the cone 52, 80 are preferably interconnected by a shrink-fit operation, wherein the cone is heated so that a cylindrical recess within the cone expands, while at least a front end 52, 72 of the stem 50, 70 is cooled so that its diameter is reduced. The shrink-fit operation forms a surprisingly reliable interconnection of a float valve stem with a cone, and substantially increases the life of the downhole float valve.

12 Claims, 1 Drawing Sheet

DRILL PIPE FLOAT VALVE AND METHOD OF MANUFACTURE

This is a division of application Ser. No. 08/534,624 filed Sep. 27, 1995, now U.S. Pat. No. 5,687,792.

FIELD OF THE INVENTION

The present invention relates to the float valve of the type commonly used in hydrocarbon recovery operations for positioning within a downhole float body. More particularly, the present invention relates to a drill pipe float valve with an improved valve member manufactured for long life.

BACKGROUND OF THE INVENTION

Float valves have long been used in oilfield drilling operations, and are preferred in some applications over flapper valves due to high reliability and long life. Float valves are increasingly used, for example, in air drilling operations wherein a drilling bit receives high pressure air which passes through the drill string and the float valve.

A float valve is commonly installed within a float body or a bored-out drill collar of a tubular string. The float body may be positioned between tool joints, and is conventionally provided with threaded box and pin connections for sealing engagement with conventional oilfield tubular threads. The back pressure action of the valve prevents cuttings from entering the drill pipe and blocking circulation as additional joints are added to the drill string. The float valve opens when the drill pipe is raised out of the hole, thereby assuring proper drainage of the drill pipe during trip-out operations, saving drilling fluids, and maintaining a relatively clean drilling rig floor.

When positioned within the float body, a float valve seals against the interior surface of the float body and provides a positive and instantaneous shutoff of both high and low pressure fluids transmitted through the float valve. The float body includes an annular seat thereon, and a valve element within the float body is biased by a spring for engagement with the seat. The float valve thus assures control of fluid flow through the drill pipe at all times.

A float valve such as the Baker SPD Model F Valve, Product No. 480-13, is widely used due to its generally trouble-free service. The float valve has relatively few parts, is easily serviced, and is highly versatile. In some downhole operations, the float valve may be inverted in the float body so that the valve may be installed between a bit and a drill collar.

Although prior art float valves are designed for rugged operations, they can experience failure downhole, primarily due to fatigue and vibration caused by cycling the valve open and closed at a high rate. During air drilling operations, for example, the float valve may open and close in excess of 100 times per minute, thereby exerting high forces on the valve element. Those skilled in the art recognize that failure of a downhole float valve or other downhole tool can have significant adverse consequences. A failed downhole float valve may cause the premature failure of other downhole tools when broken valve components engage and interfere with the normal operation of the other tools.

Prior art float valves have included a unitary valve element inclusive of both the stem and the valve cone which engages the valve seat. Due to the high cost of manufacturing this valve element, two-piece valve elements are more commonly used in float valves. The stem and the valve cone are fixedly connected during an inertia welding operation.

These inertia welded valve elements are conventionally used in float valves, although the welded connection between the stem and the valve cone may fail, typically in the heat affected zone, when the float valve is subject to high fatigue and/or vibration. Mechanically interconnecting the stem with the valve cone using fasteners or other conventional securing members is costly, and the fasteners may still fail due to the high fatigue and vibration to which the valve element is commonly subjected.

The disadvantages of the prior art are overcome by the present invention, and an improved float valve and method of manufacturing the valve element of a float valve are hereinafter disclosed.

SUMMARY OF THE INVENTION

A float valve is provided for sealing engagement with a float sub positioned downhole within a wellbore. The float sub conventionally has upper and lower threads for threaded engagement with drill pipe, and a stop shoulder for axially positioning the float valve within the float sub. The float valve includes a generally sleeve-shaped valve body or cage which has one or more external seals for sealing engagement with the float sub. The valve body also includes an internal annular seat formed on the valve body or affixed thereto. The seat is formed about a central valve axis of the float valve, and a valve member axially moves within the valve body for disengaging and engaging the seat during opening and closing of the valve. A biasing spring is provided for biasing the valve element toward its closed position. Drilling fluid (either liquid or air) thus passes through the interior of the valve body, with flow controlled by the fluid pressure and the force of the biasing spring. Depending on the application, the valve element may open and close hundreds of times per minute, and is frequently subject to high fatigue and vibration.

The valve member includes a stem for guiding axial movement of the valve member in the valve body, and a valve cone secured to the stem and configured for sealing engagement with the seat. The valve cone includes a cylindrical-shaped recess for receiving a front end of the stem during a shrink-fit operation, wherein the cone is heated relative to the stem, and the stem is then pressed into the cylindrical-shaped recess. According to a preferred technique, the cone may be heated to a temperature of from 400° F. to 1000° F. At least the front end of the stem may be cooled to a temperature of from ambient to −320° F. The stem is then pressed into the cylindrical-shaped recess. When the two valve elements thereafter are at substantially the same temperature, the shrink-fit operation will reliably secure the stem to the valve cone, even when the valve element is subsequently subjected to high fatigue and vibration. During the valve stem manufacturing operation, the front end of the stem for fitting within the cylindrical-shaped recess in the cone preferably has a cylindrical configuration with a diameter of from 0.002" to 0.010" greater than the diameter of the cylindrical-shaped recess in the cone. The shrink-fitting operation relies on thermal expansion of the cone and thus the cylindrical-shaped recess and thermal contraction of at least the front end of the stem to overcome this manufacturing differential and allow insertion of the stem into the cone recess, thereby achieving a reliable interconnection.

The valve body includes a central support for slidably receiving a rear end of the stem axially opposite the cone. An elastomeric seal is spaced axially between the biasing spring and the cone for sealing engagement with the valve body.

The cone provides a metal-to-metal seal with the valve body and the elastomeric seal provides a backup or redundant seal for the float valve. A reliable fluid-tight shutoff may be obtained even after the exterior surface of the cone or the interior surface of the valve body seat experience erosion.

According to the method of the invention, an improved valve member for a float valve is fabricated from a stem and a valve cone configured to sealingly engage the seat on the valve body. A cylindrical-shaped recess is formed in an end of the valve cone, and the front end of the valve stem has a cylindrical-shaped configuration for fitting within this recess. The diameter of the front end of the stem as manufactured is intentionally greater than the diameter of the recess in the valve cone. The parts are interconnected during a shrink-fit operation wherein the cone is heated. The stem may be maintained at ambient temperature or optionally may be cooled, and the stem then pressed or fitted into the heated cylindrical-shaped recess. The valve member formed by this method has low stress concentrations which significantly reduce the likelihood of failure during downhole operation of the float valve.

It is an object of the present invention to provide an improved valve element for a float valve of the type commonly used in hydrocarbon recovery operations, wherein the valve element comprises a stem and a valve cone which are interconnected by a shrink-fit operation. The cylindrical-shaped recess is machined into the cone, the cone is thereafter heated relative to the stem, and the stem then pressed into the cylindrical-shaped recess in the cone. It is a related object of the invention to provide an improved float valve which is simple yet highly rugged. The float valve element has minimum stress risers and has a substantially improved life when subject to high fatigue and vibration.

It is a feature of the present invention that the stem and the cone of the float valve member may be fabricated from different materials. It is also a feature of the invention that there is a reduction in the stress concentrations between the valve stem and the cone when fixedly secured together according to this technique to form the valve member, thereby reducing corrosion of the valve member when subjected to various downhole environments.

It is an advantage of the present invention that the float valve maintains a relatively simple yet rugged configuration, and may be easily serviced. The life of the float valve has been significantly increased, however, by interconnecting the stem and the cone in a shrink-fit operation.

These and further objects, features, and advantages of the present invention will become apparent from the following detailed description, wherein reference is made to the figures in the accompanying drawings.

DETAILED DESCRIPTION OF PREFERRED EMBODIMENTS

Figure 1:
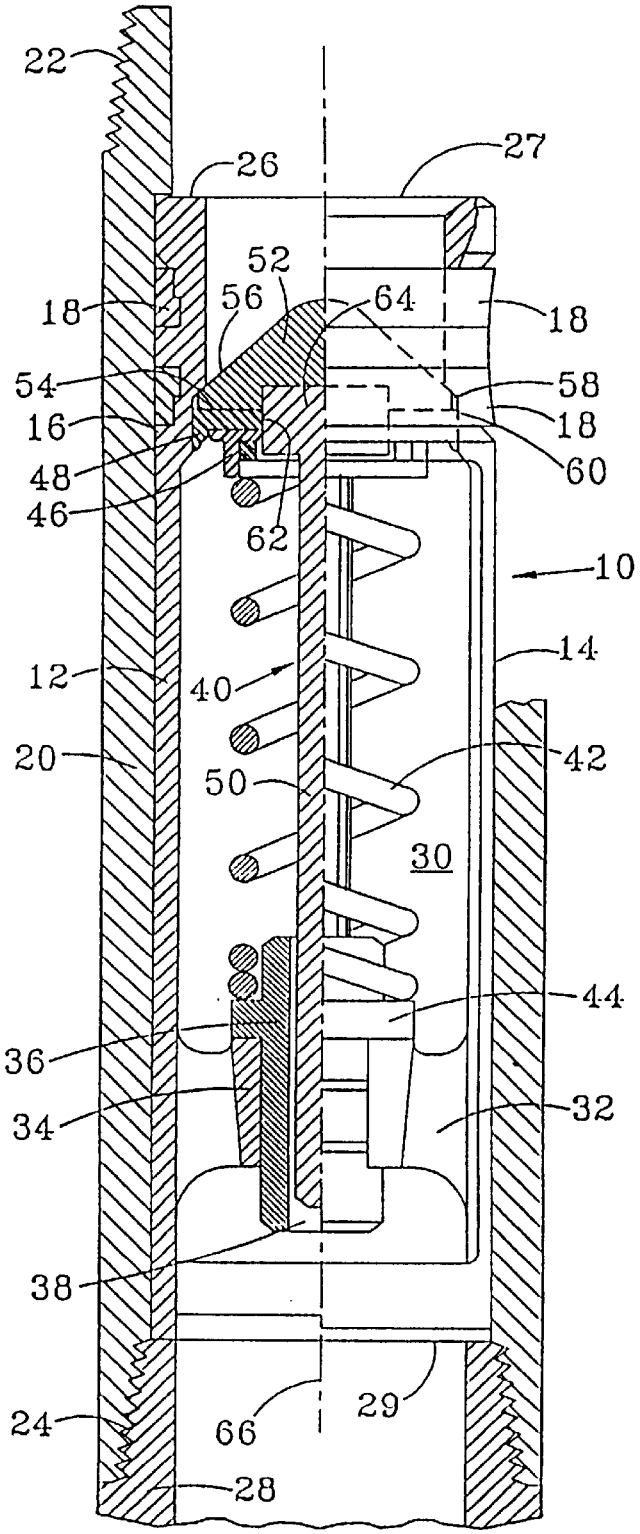
FIG. 1 is a side view, partially in cross-section, of a float valve according to the present invention positioned within a simplistic float sub.

FIG. 1 depicts a float valve 10 for positioning downhole within a well to control fluid flow. The float valve includes valve body or cage 12, which may be machined from a metal casting to reduce manufacturing costs. The valve body includes a generally cylindrical exterior surface 14, and a pair of annular grooves 16 each for receiving an exterior elastomeric seal 18 therein. The seals 18 are formed for reliable static sealing engagement with the interior surface of the float sub or body 20 which receives the float valve 10 therein. A portion of the float sub 20 is removed from the FIG. 1 illustration to depict the configuration of the seals 18 prior to engagement with the float body. The seals 18 prevent fluid from passing either uphole or downhole between the valve body 12 and the float sub 20 when the assembly is positioned downhole in a well.

In a simplistic form, the float sub 20 is a short tubular member with upper and lower threads 22 and 24, respectively, each for mating engagement with corresponding threads on a drill pipe or other downhole tool. A stop shoulder 26 is formed on the float body for engaging the end surface 27 of the float valve 10 and thereby restricting axial movement of the float valve within the float sub. The pin end 28 of a drill bit or of a drill pipe may typically engage the opposing end surface 29 of a valve body to affix the valve body within the float sub. Those skilled in the art will appreciate that the float sub 20 has been simplistically shown in FIG. 1, and that a suitable float body may have various configurations. A float sub may, for example, consist of a drill collar which is bored-out to sealingly receive the float valve 10 therein.

The generally sleeve-shaped valve body 12 includes a flow path 30 therethrough for passing fluids through the float valve. Circumferentially spaced arms 32 interconnect the sleeve-shaped body 12 with a central annular body support 34, and allow fluid to pass between the arms and thus through the float valve. A stem guide 36 fits within the central support 34, and has a passageway 38 therein for slidably receiving the valve element 40 during opening and closing of the valve. A coiled spring 42 biases the valve closed, and retains the shoulder 44 of the guide 36 in engagement with the support 34. The valve element 40 includes an elongate stem 50 and a cone 52 fixedly connected thereto. The support 34 and the guide 36 thus limit the valve element 40 to movement substantially along the central axis 66 of the float valve 10. A valve seal disk 46 is pressed by the spring 42 into engagement with an elastomeric valve seal 48, which functions as part of the valve element. The seal 48 in turn is pressed into engagement with the substantially planar surface 54 of the cone 52, thereby biasing the valve closed. The conical exterior surface 56 of the cone is configured for sealing engagement with the seating surface 58, which is fixed to and is preferably formed on the valve body. The elastomeric seal 48 seals against the annular sealing surface 60 on the valve body to provide a reliable backup to the metal-to-metal seal provided by the cone and the seat. The seal 48 also seals with the planar surface 54 on the cone, in part due to the biasing force of the spring. The radially interior surface 62 on the seal 48 is compressed into sealing engagement with the stem 50, thereby further enhancing the effectiveness of seal 48.

Figure 2:
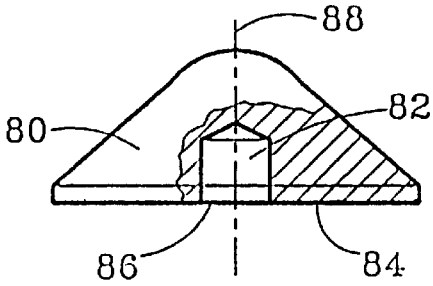
FIG. 2 is a pictorial view of another embodiment of a valve cone, illustrating the cylindrical-shaped recess formed therein.
Figure 3:
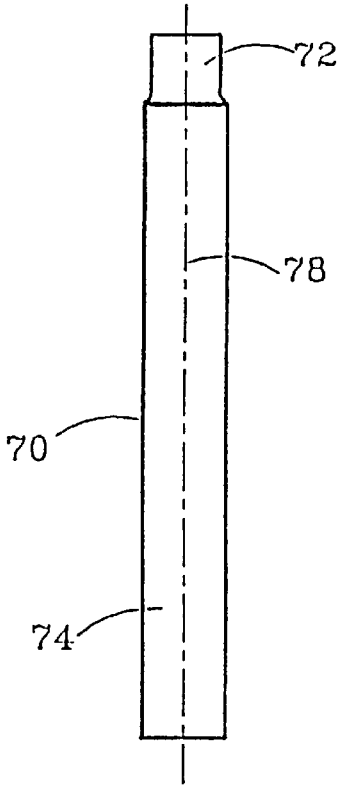
FIG. 3 is a pictorial view of a valve stem prior to being secured to the valve cone.

Referring to FIGS. 2 and 3, the stem 70 and the cone or dart 80 are separately manufactured, and thus may be formed from different materials designed to extend the life of the float valve and reduce manufacturing costs. The front end 72 of the stem 70 has a cylindrical configuration with a preselected diameter greater than the diameter of the cylindrical-shaped recess 82 within the cone. In a preferred embodiment of the invention, the diameter of the front end 72 of the stem may be from 0.002" to 0.010", and more preferably between 0.003" and 0.007", greater than the diameter of the recess 82 in the cone 80 when manufacturing the stem and the cone. The real end 74 of the stem 70 may also have a cylindrical configuration for sliding engagement within the guide 36 during opening and closing of the valve. The stem 70 is symmetrically formed about stem axis 78, and the cone 80 is similarly symmetrical about cone axis 88. When the valve element is installed within the float valve body 12, axis 78 and 88 are coaxial with central float axis 66. The tolerances for the diameter of the stem are most important for only the front end 72 of the stem. The cone 80 is formed with substantially planar end 84, with the cylindrical-shaped recess 82 passing through the planar surface 84 and into the body of the cone. Once the recess 82 is drilled or otherwise machined into the cone, the planar surface 84 is thus positioned about the entry port 86 of the recess 82.

To secure the stem to the cone, the cone is heated to a temperature of from 400° F. to 1000° F., and preferably from about 400° F. to about 500° F. This heating causes thermal expansion of the entirety of the cone, including the diameter of the cylindrical-shaped recess 82 formed therein. At the same time, at least the front end 72, and preferably the entirety of the stem 70, may be cooled to shrink the diameter of the front end 72 of the stem. The stem may be cooled to temperature of from ambient (60° F. to 80° F.) to −320° F., but also may be maintained at about ambient (60° F. to 80° F.) temperature. The temperature differential of from 320° F. to 1320° F. between the heated cone and cooled stem is thus sufficient to allow the front end 72 of the stem to be pressed into the recess 82 in the cone using a nominal axial force. The required temperature differential is a function of the diameter of the end of the stem and the diameter of the cylindrical cavity in the cone, and most importantly, the tolerances maintained when machining these diameters. The above range has been found acceptable for the downhole tool as described herein.

When the components return to about the same temperature (ambient temperature), the shrink-fit operation reliably secures the stem and the cone together. The shrink-fit operation produces minimal stress risers between the connected components, so that the valve element has a long life even when subject to high fatigue and vibration. Moreover, since the stem and the cone are not secured by a weld, the materials for these components may be selected without regard to the difficulty associated with welding dissimilar metals, thereby again reducing the manufacturing cost for the valve element.

Those skilled in the art will appreciate that the float valve and thus the valve element are frequently subject to high temperatures after the float valve is installed in a well. The float valve as described herein is able to reliably withstand various types of well fluids and well temperatures up to about 450° F. Prior art valve elements in float valves utilizing a weld between the stem and the valve cone would often fail in less than one or two days of operation. Under those same conditions, the float valve of this invention with a shrink-fit stem and cone connection may be reliably used downhole for weeks or months. Those familiar with downhole tools may initially be reluctant to accept the float valve as described herein since there may be no visible connection between the stem and the cone. The shrink-fit operation as described herein also requires precise tolerances between components to be interconnected, and shrink-fit equipment is used to heat and cool the components as disclosed herein. Equipment for shrink-fit operations is not conventionally used by manufacturers of downhole tools, and customers of float valves may be reluctant to accept the reliability of the shrink-fit connection since shrink-fit operations are not normally used to interconnect downhole components of hydrocarbon recovery tools. Nevertheless, the surprising results obtained in the experimental tests should convince customers of the benefits of the float valve according to the present invention, which will substantially reduce breakage between the valve stem and the cone, thereby reducing or eliminating a common problem with prior art float valves.

The valve element formed from the valve stem 70 and the cone 80 as shown in FIGS. 2 and 3 is functionally similar to the valve element 40 illustrated in FIG. 1. The stem 70 as shown in FIG. 3 has a substantially uniform diameter throughout the entire length of the valve stem, with only the front end 72 being precisely machined for the shrink-fit operation as disclosed herein. The valve element 40 as shown in FIG. 1 has an expanded diameter front end portion 64 which is significantly greater than the diameter of the remaining portion of the stem. The cylindrical recess formed within the cone accordingly must be sized to accept the expanded diameter portion 62 of the stem for the FIG. 1 configuration.

Various modifications to the float valve and to the method of interconnecting the stem with the cone of the float valve utilizing shrink-fit techniques should be apparent from the above description of the preferred embodiments. While the invention has thus been described in detail for these embodiments, it should be understood that this explanation is for illustration, and that the invention is not limited to the disclosed embodiments. Alternative float valves for use in downhole wells and alternative valve elements for use in float valves will be apparent to those skilled in the art in view of this disclosure. Modifications to the described structure and to the method of forming the valve element are thus contemplated and may be made without departing from the spirit of the invention, which is defined by the claims.

What is claimed is:

1. A method of forming a valve member axially movable within a valve body of a float valve positionable downhole for sealing engagement with a float body within a wellbore, the valve body having an external seal for sealing engagement with the float body and an internal annular seat secured to the valve body and formed about a central axis of the float valve for sealing engagement with the valve member, the method of forming the valve member comprising:

forming an elongate stem for guiding axial movement of the valve member within the valve body, the elongate stem having a front end portion with a cylindrical configuration of a selected first diameter;

forming a valve cone for engagement with the internal annular seat, the valve cone having a cylindrical-shaped recess therein of a selected second diameter less than the first diameter for receiving the front end portion of the stem;

heating the valve cone to a temperature of from 320° F. to 1320° F. higher than that of the stem; and inserting the front end portion of the stem in the cylindrical-shaped recess of the heated cone for forming a shrink-fit connection between the stem and the cone.

2. The method as defined in claim 1, further comprising:

cooling at least the front end portion of the stem prior to inserting the front end portion of the stem into the cylindrical-shaped recess in the heated cone.

3. The method as defined in claim 1, further comprising:

forming the selected first diameter of the front end portion of the stem from 0.002" to 0.010" greater than the selected second diameter of the cylindrical-shaped recess.

4. The method as defined in claim 1, further comprising:

forming a substantially planar rear surface on the cone about an entry port into the cylindrical-shaped recess; and positioning an elastomeric seal on the planar rear surface of the cone for sealing between the cone and the valve body.

5. The method as defined in claim 1, further comprising:

forming a rear end of the stem for sliding engagement with the valve body during opening and closing of the float valve.

6. A method of forming a valve element axially movable within a valve body of a float valve positionable downhole for sealing engagement with a float body within a wellbore, the valve body having an external seal for sealing engagement with the float body and an internal annular seat secured to the valve body for sealing engagement with the valve element, the method of forming the valve element comprising:

forming an elongate stem for guiding axial movement of the valve element within the valve body, the elongate stem having a front end portion with a selected first cross-sectional size;

forming a valve member for engagement with the internal annular seat, the valve member having a recess therein of a selected second cross-sectional size less than the first cross-sectional size for receiving the front end portion of the stem;

heating the valve member to a temperature of from 320° F. to 1320° F. higher than that of the stem; and inserting the front end portion of the stem in the recess of the heated valve member for forming a shrink-fit connection between the stem and the valve member.

7. The method as defined in claim 6, further comprising:

cooling at least the front end portion of the stem prior to inserting the front end portion of the stem into the recess in the heated valve member.

8. The method as defined in claim 6, further comprising:

forming the front end portion of the elongate stem to have a cylindrical configuration with a selected first diameter; and forming the recess in the valve member to have a cylindrical-shaped configuration with a selected second diameter less than the first diameter.

9. The method as defined in claim 8, further comprising:

forming the selected first diameter of the front end portion of the stem from 0.002 inches to 0.010 inches greater than the selected second diameter of the cylindrical-shaped recess.

10. The method as defined in claim 1, further comprising:

forming a substantially planar rear surface on the valve member about an entry port into the recess; and positioning an elastomeric seal on the planar rear surface of the valve member for sealing between the valve member and the valve body.

11. The method as defined in claim 6, further comprising:

forming a rear end of the stem for sliding engagement with the valve body during opening and closing of the float valve.

12. The method as defined in claim 6, further comprising:

forming a generally cone-shaped exterior surface on the valve member for engagement with the internal annular seat.

* * * * *

UNITED STATES PATENT AND TRADEMARK OFFICE

CERTIFICATE OF CORRECTION

PATENT NO. : 5,850,881
DATED : December 22, 1998
INVENTOR(S) : John E. Rodger, et al.

It is certified that error appears in the above-indentified patent and that said Letters Patent is hereby corrected as shown below:

In claim 10, line 1, change "claim 1" to -- claim 8--.

Signed and Sealed this

Fourth Day of May, 1999

*Attest:*

Q. TODD DICKINSON

*Attesting Officer*

*Acting Commissioner of Patents and Trademarks*